United States Patent [19]

Ekholm et al.

[11] Patent Number: 4,895,223

[45] Date of Patent: Jan. 23, 1990

[54] METHOD FOR SUB-ZONING AN ELEVATOR GROUP

[75] Inventors: Ralf Ekholm, Helsinki; Riitta Partanen-Jokela, Hyvinkaa, both of Finland

[73] Assignee: Kone Elevator GmbH, Baar, Switzerland

[21] Appl. No.: 206,754

[22] Filed: Jun. 15, 1988

[30] Foreign Application Priority Data

Jun. 17, 1987 [FI] Finland ..... 872706

[51] Int. Cl.[4] ..... B66B 1/20

[52] U.S. Cl. ..... 187/125; 187/128

[58] Field of Search ..... 187/101, 124, 125, 127, 187/128

[56] References Cited

U.S. PATENT DOCUMENTS

| | | | |
|---|---|---|---|
| 3,506,093 | 4/1970 | Suozzo et al. | 187/128 |
| 3,648,805 | 3/1972 | Suozzo et al. | 187/128 |
| 4,305,479 | 12/1981 | Bittar et al. | 187/125 |
| 4,499,975 | 2/1985 | Tsuji | 187/125 |
| 4,691,808 | 9/1987 | Nowak et al. | 187/125 |

*Primary Examiner*—William M. Shoop, Jr.
*Assistant Examiner*—W. E. Duncanson, Jr.
*Attorney, Agent, or Firm*—Dennison, Meserole, Pollack & Scheiner

[57] ABSTRACT

A method for increasing the transportation capacity of elevators in a building involving dividing the elevators (2–7) into two or more groups, each comprising one or more elevators, in such manner that in certain loading situations the groups will temporarily serve different zones (11, 12) of the building (1). Upward peak traffic conditions are detected and the boundaries between zones (11, 12) are determined and maintained by the steps which include:

(a) detecting by a peak traffic condition, mainly on the basis of elevator loading time and/or the number of people arriving in an elevator lobby (9) of the building (1).

(b) calculating an initial optimal zone boundary value mainly on the basis of traffic statistics and existing transportation capacity.

(c) effecting transition of elevator operation to sub-zoning during upward peak traffic.

(d) re-calculating the optimal zone boundary value mainly on the basis of short-term traffic statistics, the number of people in the elevator lobby and the available transportation capacity.

(e) sensing the need for change in the zone boundary and effecting the desired change as calculated in section (d).

(f) cancelling the sub-zoning upon completion of the upward peak passenger period or when the volume of upward traffic has fallen below a predetermined limit.

7 Claims, 5 Drawing Sheets

METHOD FOR SUB-ZONING AN ELEVATOR GROUP

FIELD OF THE INVENTION

The present invention relates to a method for increasing the transportation capacity of general elevators in a building by dividing the elevators into two or more groups, each comprising one or more elevators, in such manner, that in certain loading situations, the groups will temporarily serve different zones of the building.

It is desirable that the control system of an elevator group be so designed that the group, structured according to general practice, is able to provide the required transportation to all passengers even during peak ascending traffic hours in such a manner that the development of queues of people waiting for elevators is either avoided or significantly minimized.

THE PRIOR ART

In a known method, the building is divided into two fixed zones during heavy ascending traffic periods during which about half of the elevators exclusively serving the upper zone and the rest the lower zone. Using methods of statistical mathematics as employed in the structuring of elevator groups, it can be proved that the additional capacity thus achieved is in the range of about 20–40%, depending on the size of the elevator group, the type of elevators used, the traffic characteristics and the number of sub-zones.

However, this solution has several distinct drawbacks, one of the worst being that during a peak period of ascending traffic the traffic is not equally distributed between all floors of the building but may instead be concentrated in different parts of the building at different times during the peak ascending traffic period. In these circumstances, the quality of service may significantly deteriorate in those parts of the building in which there is more than an average amount of traffic.

Another notable disadvantage is that when one or more elevators must for some reason be removed from normal service, the elevator control system has no provision for re-zoning, with the result that queues of people develop for the rest of the elevators of the group concerned. This problem also applies in the case of goods and VIP transport both of which may take up a significant portion of the transportation capacity, especially in large buildings. Due to lack of supervision, this type of separate elevator transport use often occurs during peak traffic periods even though this is against general recommendation.

The deterioration in service quality automatically leads to the result that those passengers who have to wait for an elevator for long periods become impatient and thus do not pay due attention to passenger information and directions. They may for example enter the wrong elevator in the hope of arriving at their destination one way or another, or they may conclude that they will arrive at their destination more speedily by first riding to a selected floor which is not their final destination and then changing elevators. This approach results in an unnecessary reduction of the transportation capacity of the elevator group, and it becomes difficult for the group control system to recover from the low service condition before the peak traffic period has diminished.

It is naturally possible to employ operators to manually operate the elevators as efficiently as possible while also taking care that the passengers fill the cars quickly and correctly during peak periods of ascending traffic. However, one of the drawbacks of this method is that the elevator services can not be properly coordinated because the operators do not see each other during peak traffic periods and this fact often leads to severe elevator bunching and consequently long waiting times even if the transportation demand does not exceed the available capacity. Additionally, the zone boundaries can not be quickly changed if the traffic is unevenly distributed. Such a manually controlled system also involves considerable extra cost.

There are other weaknesses embodied in the known methods. For example, the downward and interior traffic, although small in volume, and beginning towards the end of the upward rush, tends to cause a cancellation of the temporary zoning with fixed zone boundaries. This is due to the fact that the control system is unable to handle this sort of mixed traffic properly. Therefore, it is not possible to apply controlling restrictions to limit the elevator services for the passengers travelling in the opposite direction during the rush e.g. by causing them to wait significantly longer than average for their elevators Thus, the rush-time transportation capacity of the whole elevator group begins to deteriorate because of mixed traffic before the rush is over.

An object of the present invention is to provide a flexible and efficient method for dividing the elevator capacity of a building into appropriate groups during upward peak traffic.

According to the present invention a method for increasing the transportation capacity of elevators in a building by dividing the elevators into two or more groups, which comprises one or more elevators, in such a manner that in certain loading conditions said groups will temporarily serve different zones of said building and wherein an upward peak traffic elevator condition is detected and the boundaries between said zones are determined and maintained by the following steps:

(a) detecting a peak traffic condition mainly on the basis of elevator loading time and/or the number of people arriving in an elevator lobby of said building.

(b) calculating an initial optimal zone boundary value, mainly on the basis of traffic statistics and existing transportation capacity.

(c) effecting transition of elevator operation to sub-zoning during upward peak traffic.

(d) re-calculating the optimal zone boundary value mainly on the basis of short-term traffic statistics, the number of people in the elevator lobby and the available transportation capacity.

(e) sensing the need for change in the zone boundary and effecting the change thereof as calculated in section (d) hereof.

(f) cancelling the sub-zoning upon completion of the upward peak passenger period or when the volume of upward traffic has fallen below a predetermined limit.

THE DRAWINGS

The invention is described in further detail with reference to the accompanying drawings, in which:

FIG. 1 is a diagram of a building embodying a group of six elevators serving eighteen floors and a machine room housing the control equipment;

FIG. 2 diagrammatically shows the building of FIG. 1 with the elevator group divided into two zones;

DETAILED DESCRIPTION OF THE INVENTION

Figure 1:
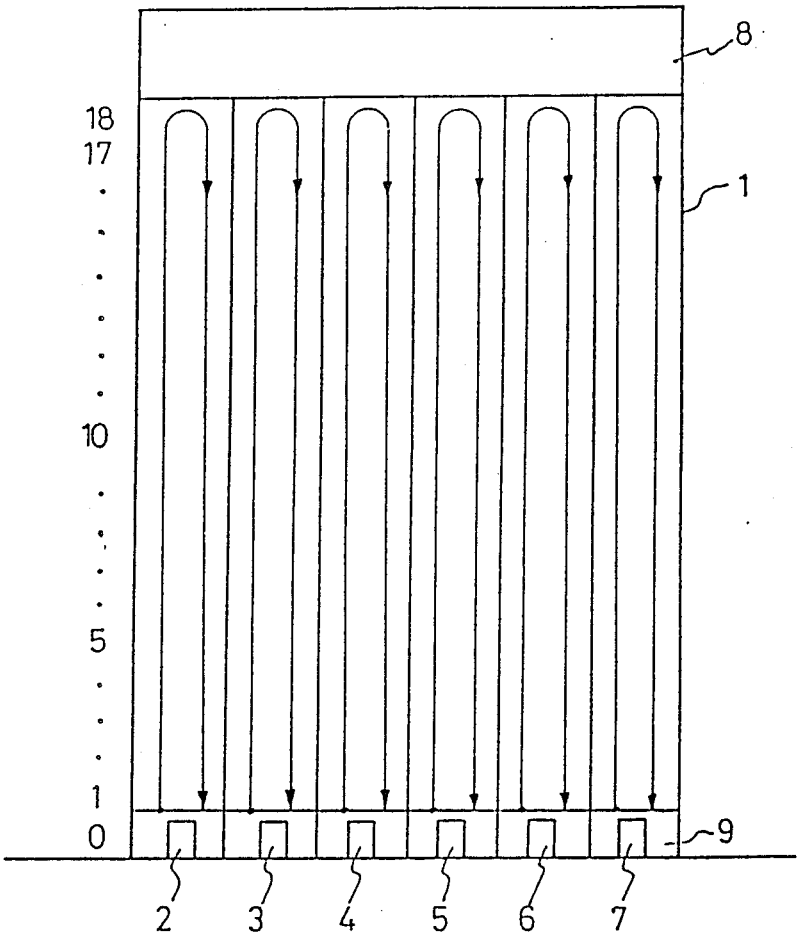
Figure 2:
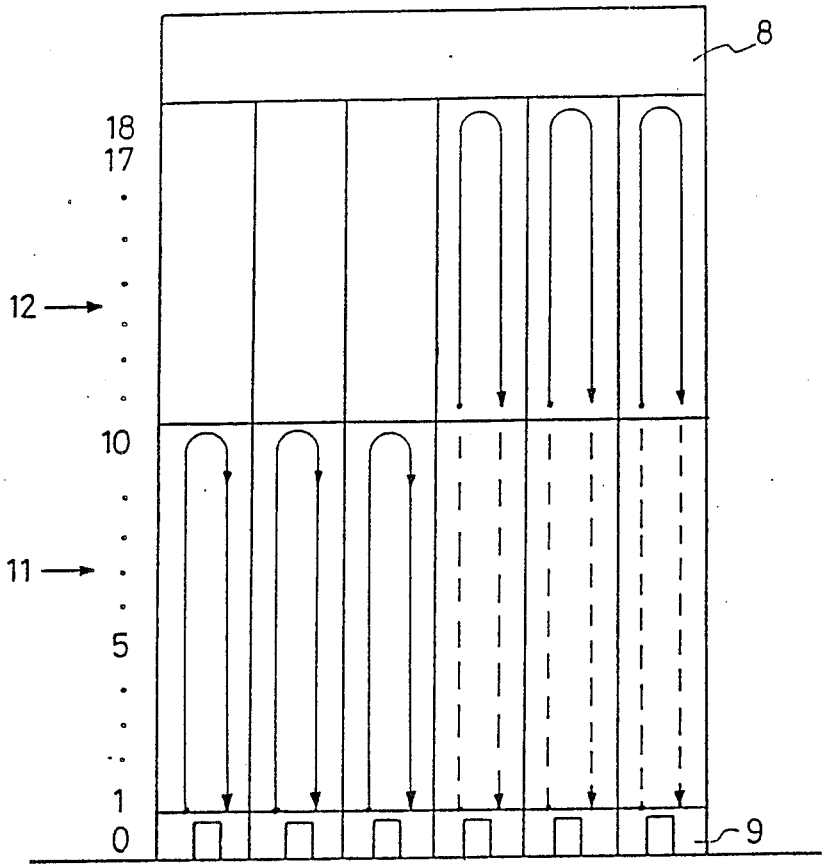

The diagram of Figure represents a large building 1 in which a group of six elevators 2–7 serves eighteen floors. The figure also shows the elevator machine room 8 and the lobby 9. FIG. 2 represents the building of FIG. 1 with the elevators divided into two subgroups 11 and 12 serving the floors 1–10 and 11–18 respectively.

Figure 3:
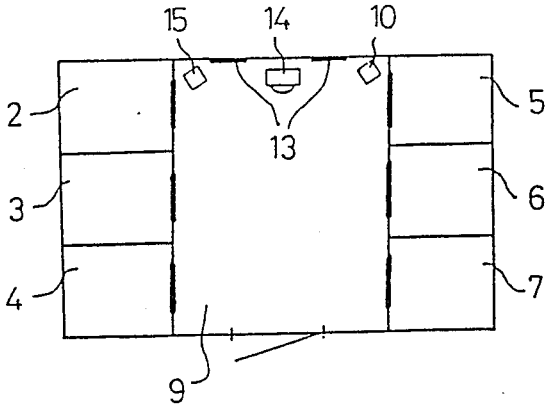
FIG. 3 is a diagram showing an elevator lobby on the ground floor of a building With the six elevators placed in the common manner in two groups of three on opposite sides of the lobby.

FIG. 3 shows the elevator lobby on the ground floor with six elevators located in the usual manner in groups of three on opposite sides of the lobby. The lobby is also provided with a computer 10, which is connected to a display 13 placed on one end wall of the lobby. Connected to the lobby computer 10 is also a traffic indicator 14 for displaying the elevator movements, and a radar 15 for counting the people who stop in the lobby to wait for an elevator (see e.g. Finnish patent application 800954). When the elevators are divided into two or more groups to serve different zones, it is also appropriate to consider the layout of the elevator groups in the lobby 9 to ensure that the elevators serving different zones are separated from each other so as to avoid cross-crossing of the paths of people point to different zones. With reference to FIG. 3, it should be noted that all the three elevators (2, 3 and 4) on the left serve one zone while those on the right (5, 6 and 7) serve the other.

Figure 4:
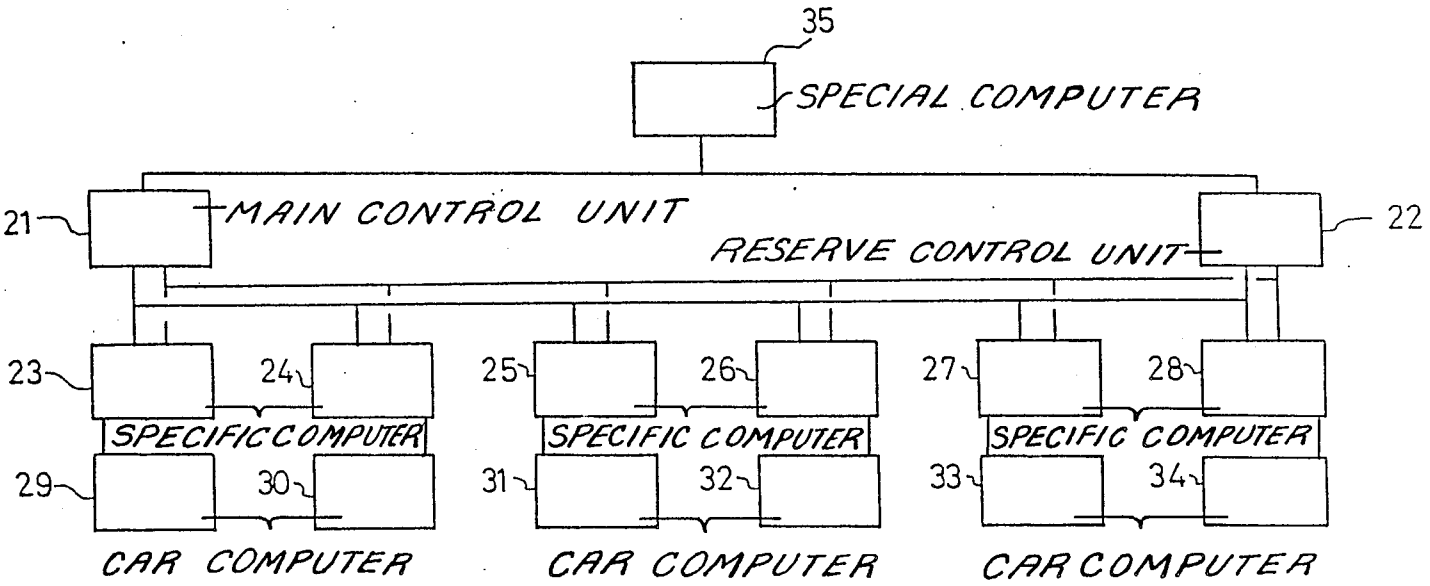
FIG. 4 (PRIOR ART)
FIG. 4 is a block diagram of a known elevator group control system.

FIG. 4 is a block diagram of the control system of a modern six-elevator group, comprising a main control unit 21, a reserve control unit 22, elevator-specific computers 23–28 for individual elevator control and adjustment, corresponding computers 29–34 located in the elevator cars, and a special computer 35 communicating with the control room of the building.

Figure 5:
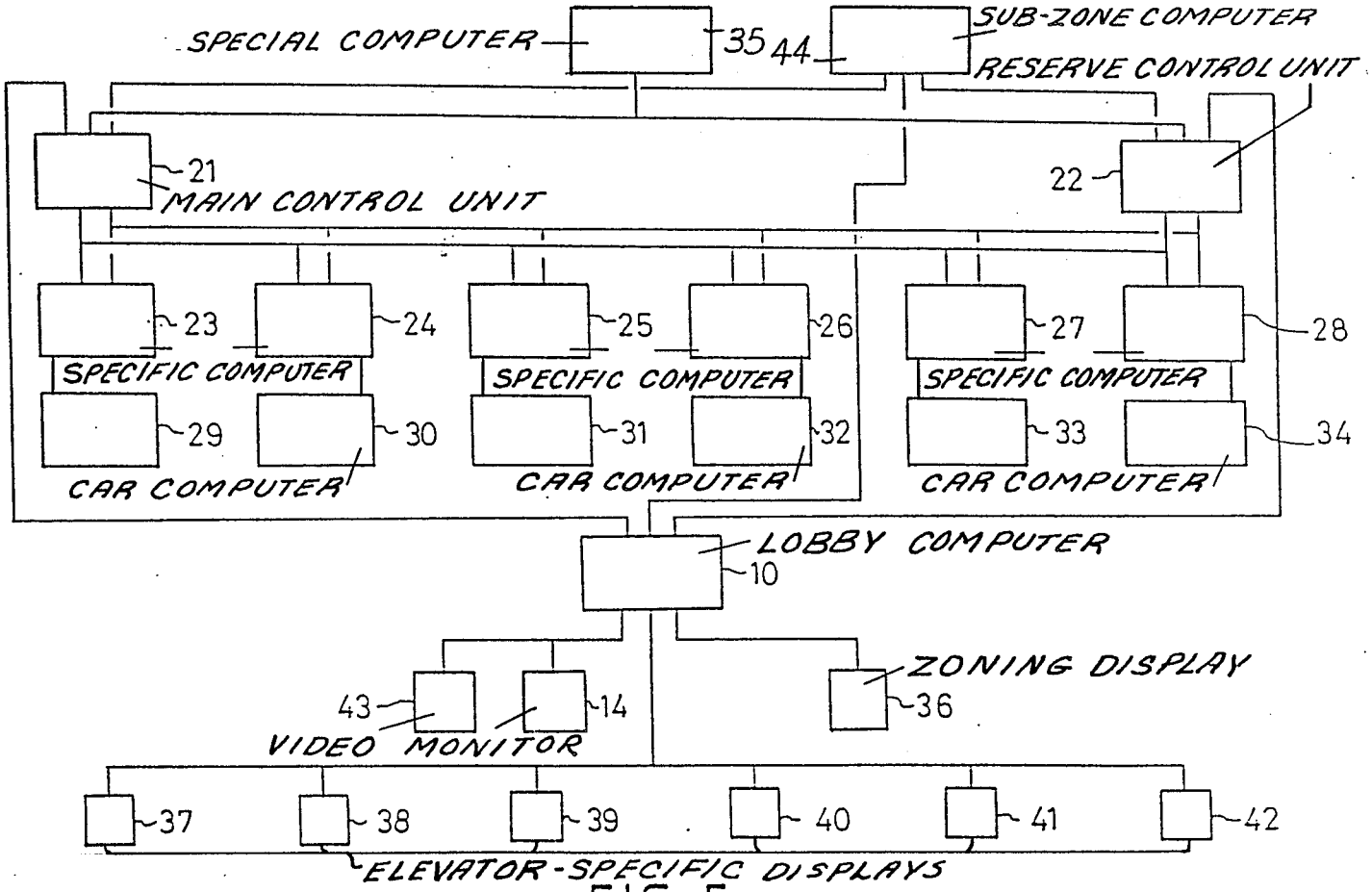
FIG. 5 shows the control system of FIG. 4 with the addition of a sub-zoning control system of the present invention.

FIG. 5 represents the control system of FIG. 4, with the addition of a sub-zoning control system as provided by the invention, which is active during the rush period of ascending passengers. The sub-zoning control system comprises a computer 44 for execution of the subzoning algorithm and the equipment 10, 14, 36–43 required for providing the necessary information on the zoning and the changes thereof. The sub-zoning computer 44 transmits the zoning data to the lobby computer 10, which, based on these data, controls the zoning display 36, the video monitors 14 and 43 showing the elevator movements, and the of the lobby and the layout of the elevators, it may be necessary to use additional monitors and/or the information provided by the traffic monitors may vary.

In the embodiment of the invention diagrammatically shown in FIG. 5, the sub-zoning algorithm is placed in a separate computer 44 which commands the group control computers 21 and 22 during the peak period of upwardly ascending passengers. The algorithm may also be placed in one or both computers (e.g. to provide a back-up function) of the group control computers.

Figure 6:
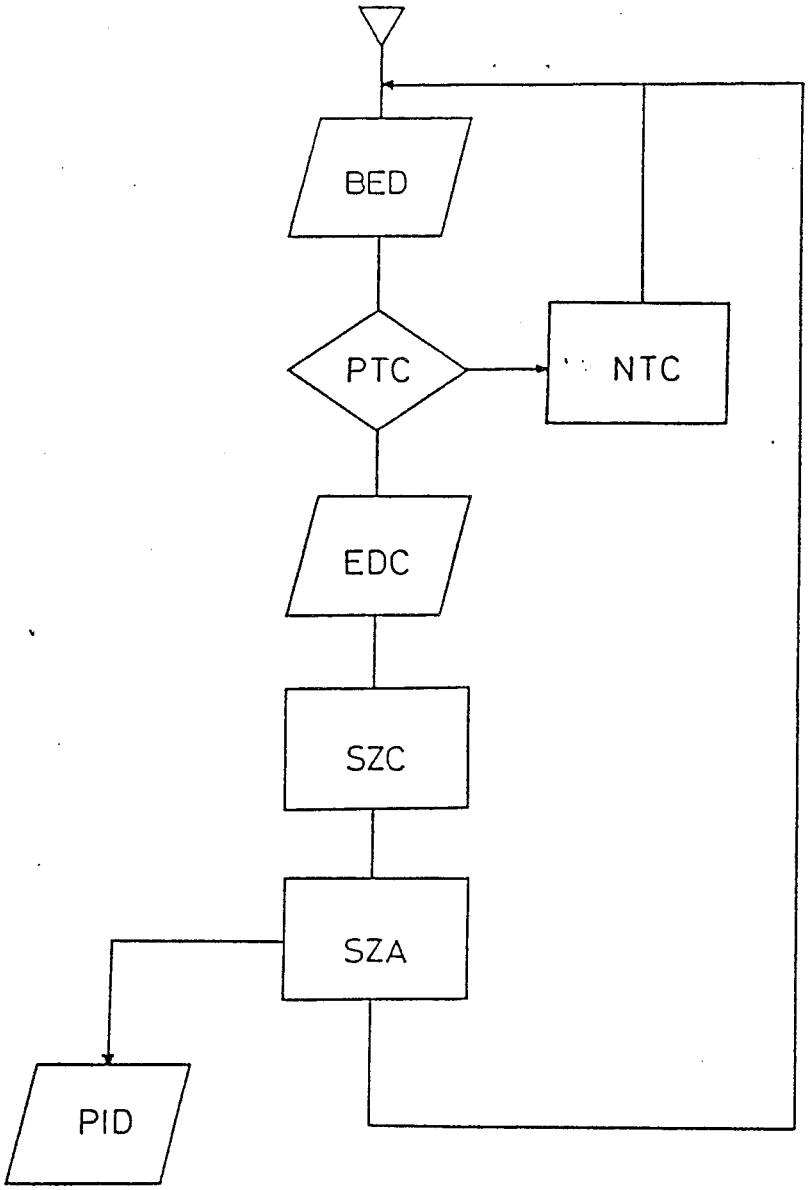
FIG. 6 is a flow chart showing an operational layout of the control system of the invention.

During the rush-time operation of the control system, several phases can be distinguished, as shown by the diagram in FIG. 6. The zoning algorithm is a continuous checking routing which collects information from the various parts of the elevator system. The important data includes those concerning the traffic flow, which are collected in the block designated as BED (Basic Elevator Data). These data include long-term traffic flow statistics, radar data, i.e. the number of people waiting in the lobby on the ground floor at each moment, and short-term traffic flow statistics. The statistical data comprise various information collected earlier for a corresponding time interval, e.g. the number of departures, the loads of the cars at each departure, the number of distribution of calls, and the number of passengers leaving the cars at each floor. The division between long-term and short-term information depends on the application. However, "short-term" can be regarded as referring to time intervals of a few minutes to a few days, whereas "long-term" statistics may cover information gathered during the entire existence of the system.

In large buildings, the upward rush or peak period of ascending passengers develops gradually. A peak traffic condition may be developed in a matter of a few minutes to half an hour or so. The computer 44, which at this stage is mainly occupied with processing momentary load data, compares the load data to certain set limits and decides when the upward rush of passengers begins. This is done in the PTC (Peak Traffic Condition) block of FIG. 6. If the test result is negative (FALSE), the computer decides that a normal condition still prevails and keeps the elevator group under normal traffic control (NTC). If certain criteria are met during a certain time interval, e.g. two minutes, for example when a given number of elevator cars with a load exceeding a given limit, e.g. 70% of nominal load, have departed in the up-direction, then the PTC test yields a TRUE result. The conclusions to be reached through the PTC test can be controlled by means of long-term or short-term traffic statistics, for instance in such manner that the subzoning algorithm is not activated outside the normal peak traffic hours as easily as during the rush time, because if an increased transportation demand appears in the normal traffic hours, it is likely to be caused by a temporary loading peak (e.g. groups of visitors), which can be tolerably handled by normal group control.

Before switching over to the sub-zoning mode, the computer 44 performs a check in the ECD (Elevator Capacity Data) block to determine how much elevator capacity is available so as to make it possible to consider a reduction in required transportation capacity if some of the elevators are used for special purposes, such as goods or VIP transport.

By analyzing the traffic distribution in the building, the computer 44 can calculate the optimal zone boundary value in the SZC (Sub-Zone Calculation) block of the diagram. In practice the zone boundary means that particular floor of the building when the average loads of arriving elevators which cannot go any further are about the same as the loads in the elevators for which the floor in question or the next floor is the first stop on their way up. The calculation of the sub-zoning boundary consists of a number of basic operations involving the traffic distribution data and can therefore be performed in many different ways. An example is given below to illustrate the principle.

The calculated theoretical optimum zone boundary as well as the starting values used in previous peak traffic situations are stored in the memory of the computer. When the traffic condition requires activation of the sub-zoning, the computer compares the momentary optimal starting value obtained from fresh calculations to the previous values, the weighted average of which is stored in its memory. If the elevators are in an initial state, for example, they are only just being started up for first operation or they are otherwise in a special condition, a theoretical optimum value is used. If the difference between the statistical value and the calculated value for the zone boundary does not exceed a certain permitted threshold, e.g. 15%, the computer will accept the statistical value. If the difference is greater, the zone boundary value is only corrected by a certain increment at a time, e.g. by one floor in the direction indicated by the new calculated value. The same principle also applies when the zone boundaries are changed during peak traffic, as explained below. Because it is always preferable to take the number of people waiting in the lobby into account in the calculation of the zone boundary, as is also explained below, this information can also be utilized in determining the initial zone boundary, especially if a large increase in the number of people waiting for an elevator occurs in a short time.

The sub-zoning is effected in the SZA block (Sub-Zone Activation). The computer 44 sends the new zone boundary data to the lobby computer 10 and instructs it to activate the passenger information display functions (block PID, Passenger Information Display) to guide the passengers to the right elevators. The passenger information functions are implemented by means of the equipment shown in FIG. 8, comprising a zone boundary display 36, video monitors 14 and 43 displaying the elevator movements, the elevator-specific displays 37–42. The zoning data for all elevators of the group are changed simultaneously, but all calls registered before the change are first served normally.

Next, the algorithm performs a new round of checks, i.e. returns to the BED block. During this time the sub-zoning computer 44 is monitoring the operation of the system with the new zone boundary and performing calculations to determine if there is a need to change it. If the difference between the calculated value and the current boundary values does not exceed a certain threshold, in this case e.g. 10%, the computer will not change the boundary. If the difference is greater, the zone boundary value is only corrected by a certain increment at a time, e.g. by one floor in the direction indicated by the new calculated value. To avoid repeated changes of the boundary value e.g. between two floors, the algorithm employs a certain hysteresis When the calculations indicate the need for a change in the opposite direction, by applying a higher threshold value, in the present case 15%. For the calculation of the zone boundary value, it is useful to consider the number of people waiting in the elevator lobby 9, because even during a rush period there may appear specific peaks, which can be caused by occurrences such as underground trains arriving at a station directly under the building and other diverse causes. In such cases, if the number of people waiting in the lobby is found to be exceptionally large, this information should be treated as a decisive factor in the calculation of the zone division.

When the traffic conditions require cancellation of the sub-zoning applied during an upward rush, this is done in the PTC block in the diagram in FIG. 6, because the computer continuously monitors the traffic, e.g. during each cycle of calculations, to decide whether or not a peak traffic condition exists. The PTC block may also comprise an alternative terminating branch in Which the internal traffic in the building is taken into account for example in such a manner that if the internal traffic volume exceeds a certain appreciable portion of the total traffic, the sub-zoning is cancelled even if a peak traffic condition still prevails on the ground floor. This may sometimes be necessary such as towards the end of the peak traffic phase to avoid completely jamming the internal traffic.

The lay-out in FIG. 6 represents a simplified embodiment of the method of the invention. The chain of decisions and actions forming the essence of the invention can be implemented in various ways. For instance, the calculations required for determining the zone boundary can be performed at a different logical stage, such as after a test of the need for change, then the calculation of the initial optimal zone boundary value.

Moreover, the calculation of the zone boundary value during peak traffic can be based on producing alternative values by considering the information provided by long-term statistics, so that the boundary can be changed immediately when the appropriate traffic condition appears.

To allow for cases of exceptional elevator loading, the algorithm can incorporate a provision for changing the elevator grouping described in connection with FIG. 3, or detaching one or more elevators from the group and assigning them the role of freely moving "all zone" elevators. In certain situations such measures may increase the total transportation capacity of the system at the cost of service quality during peak traffic, such as when a moderate amount of important internal traffic has to be handled in peak traffic hours. In relation to the algorithm and the invention, such elevators can be regarded as a group serving a zone that covers all floors of the building, the zone boundary for the group being determined on the basis of the time of starting and the number of detached elevators used.

As stated before, the method of the invention need not necessarily be implemented using a separate computer 44. The logic performing the functions of the method can also be placed in the group control computers 21 and 22, the control room computer 35 or even in the lobby computer 10. Thus, it will be obvious to a person skilled in the art that the embodiments of the invention are not restricted to the example discussed above but may instead be varied within the scope of the following claims.

We claim:

1. A method for increasing the transportation capacity of elevators in a building by dividing the elevators into two or more groups, each comprising one or more elevators, in such a manner that in certain loading conditions said groups will temporarily serve different zones of said building and wherein an upward peak traffic elevator condition is detected and the boundaries between said zones are determined and maintained by the following steps:

(a) detecting a peak traffic condition mainly on the basis of elevator loading time and/or the number of people arriving in an elevator lobby of said building.

(b) calculating an initial optimal zone boundary value, mainly on the basis of traffic statistics and existing transportation capacity.

(c) effecting transition of elevator operation to sub-zoning during upward peak traffic.

(d) re-calculating the optimal zone boundary value mainly on the basis of short-term traffic statistics, the number of people in the elevator lobby and the available transportation capacity.

(e) sensing the need for change in the zone boundary and effecting the change thereof as calculated in section (d) hereof.

(f) cancelling the sub-zoning upon completion of the upward peak passenger period or when the volume of upward traffic has fallen below a predetermined limit.

2. A method according to claim 1, wherein long-term and short-term traffic statistics for previous traffic flow situations are utilized as an aid in the detection of a peak traffic condition.

3. A method according to claim 1, wherein information regarding the number of people entering the elevator lobby is used as an aid in the calculation of the optimal initial zone boundary value.

4. A method according to claim 1, wherein long-term traffic statistics are used as an aid in the recalculation of the optimal zone boundary value.

5. A method according to claim 1, wherein when the recalculated zone boundary value indicates a need for changing the boundary towards its previous value, a threshold beyond the midpoint of the zone boundary change is observed in making the decision to change.

6. A method according to claim 1, wherein when the elevators are divided into two or more groups to serve different zones of the building, the layout of the elevator groups in the lobby is taken into account to ensure that the elevators serving different zones are separated from each other so as to avoid crisscrossing of the paths of people going to different zones.

7. A method according to claim 1, wherein as selectively required a grouping of the elevators is altered or one or some of the elevators are given the status of freely moving all zone elevators.

* * * * *